US005282951A

United States Patent [19]

Delmee et al.

[11] Patent Number: 5,282,951

[45] Date of Patent: Feb. 1, 1994

[54] METHOD FOR FORMING A SIEVE MATERIAL HAVING LOW INTERNAL STRESS AND SIEVE MATERIAL SO OBTAINED

[75] Inventors: Petrus H. M. Delmee, Rosmalen; Karst J. van Weperen, Uden, both of Netherlands

[73] Assignee: Stork Screens, B.V., at Boxmeer, Netherlands

[21] Appl. No.: 810,305

[22] Filed: Dec. 19, 1991

[30] Foreign Application Priority Data

Dec. 24, 1990 [NL] Netherlands ..... 9002866

[51] Int. Cl.[5] ..... C25D 1/08

[52] U.S. Cl. ..... 205/75; 205/122; 205/150

[58] Field of Search ..... 205/75, 150, 122

[56] References Cited

U.S. PATENT DOCUMENTS 4,108,740 8/1978 Wearmonth ..... 205/75
4,575,406 3/1986 Slafer ..... 205/75
4,772,540 9/1988 Deutsch et al. ..... 205/75
4,913,783 4/1990 Piolat ..... 205/75

FOREIGN PATENT DOCUMENTS 0341167 11/1989 European Pat. Off. .

OTHER PUBLICATIONS

Modern Electroplating, 3rd Edition, F. A. Lowenheim, Ed., pp. 297 and 302, only, 1973.

*Primary Examiner*—John Niebling
*Assistant Examiner*—Patrick J. Igoe
*Attorney, Agent, or Firm*—Michael N. Meller

[57] ABSTRACT

Described is a method for forming a sieve material in which a sieve skeleton is thickened in an electrolysis bath with metal; in the bath as used at least one chemical compound is present having properties of both a first and second class brightener in such concentration and added with such a rate in view of the Ah (ampere hour) load that the internal stress in the finished sieve material is reduced in comparison to a sieve material produced in a bath comprising a conventional compound under conventional conditions. The invention also relates to a sieve material formed with the method described.

11 Claims, 6 Drawing Sheets

METHOD FOR FORMING A SIEVE MATERIAL HAVING LOW INTERNAL STRESS AND SIEVE MATERIAL SO OBTAINED

BACKGROUND OF THE INVENTION

The present invention relates to a method for forming a sieve material by thickening a previously formed electrically conductive sieve skeleton by metal deposition in an electrolysis bath until the final thickness of the sieve material has been reached, one or more chemical compound(s) being present in the electrolysis bath used for the metal deposition having the properties of a second-class brightening agent.

Such a method is disclosed by EP-B1-0 038 104.

Said publication describes how a sieve skeleton is formed on a suitable matrix by electrolytic metal deposition. Said sieve skeleton is removed from the matrix and is thickened in an electrolytic metal deposition bath until a desired final thickness has been reached. During the thickening of the metal sieve skeleton, a chemical compound which has properties of a second-class brightening agent is present in the bath. For a description of such chemical compounds, reference is made to Modern Electroplating; 3rd edition John Wiley & Sons; 1973; page 296 et seq, and in particular, page 302 et seq.

The patent publication cited above describes how a less rapid closure by growth of the perforations in the sieve skeleton occurs in the presence of a chemical compound which has the properties of a second-class brightening agent since a preferred growth direction can be observed which is perpendicular to the plane of the sieve skeleton. In other words, in the presence of a chemical compound having properties of brightening agent of the second class, the sieve skeleton will exhibit less growth in the plane of the sieve skeleton (with reduction in size of the perforations) and more growth in the direction perpendicular to the plane of the sieve skeleton. On-checking, growth ratios of greater than 1.5 are observed. That is to say, the largest total growth perpendicular to the plane of the sieve skeleton is 1.5 times as great as the largest total lateral growth of a crosspiece in the plane of the sieve skeleton.

In view of the desired properties during the later use of the sieve material, it is often advisable to subject the thickened sieve skeleton material to an annealing treatment by heating said material under controlled conditions.

Such an annealing treatment is disadvantageous because it employs an additional treatment under controlled conditions and the Applicant has therefore searched for a method with which the need for such an annealing treatment is superfluous.

SUMMARY OF THE INVENTION

Surprisingly, the applicant has now found that such an object is achieved by ensuring in a method of the specified type that at least one chemical compound is used having also properties of a first class brightening agent said compound being present in the bath in such concentration and being added to the bath in such proportionality to the Ah (Ampere hour) load that the internal stress of the finished sieve material with respect to a material formed using one or more commonly used chemical compounds is reduced.

Specifically the applicant has found, (as will be further specified in greater detail) that there are chemical compounds which, in connection with their use in the electrolysis bath used for the thickening, result in an internal stress which is reduced with respect to a sieve material that is obtained in the same way and which has the same final thickness using a commonly used chemical compound having properties of a second-class brightening agent such as, for example, butynediol or ethylenecyanohydrin.

In particular, in the method of the type described a sulphur comprising organic compound having at least one unsaturated bond in the molecule is used in an initial concentration of at least 0.25 mmol/liter of bath liquid and an addition rate of at least 1 mol/10,000 Ah load; in particular in an initial concentration of at least 0.75 mmol/liter of bath liquid and an addition rate of at least 3 mol/10,000 Ah load.

It is observed that in Ep-A-0341167 the use of certain sulphur comprising pyridinium compounds in an application as herein concerned is described.

No indication whatsoever is however given that the pyridinium compounds are used in such concentration and addition rate that a reduction in internal stress is observed. In said reference is described that, according to a preferred embodiment, a conventional stress reducer is added to the thickening bath in addition to the pyridinium compound. No indication is given about the initial concentration of pyridinium compound; further the addition rate per 10,000 Ah load is around 1 mol of the compound concerned as a maximum whereas in the present invention an addition rate of 1 mol per 10,000 Ah constitutes a minimum.

The present inventors have found that a reduction of tensile stress may be achieved by using a certain minimum amount of compound having properties of both a first and second class brightener; the range of usable compounds comprises the pyridinium compounds as mentioned and a large variety of equivalent compounds as will be explained hereinafter.

When carrying out the method according to the invention the use of a second class brightener (such as a sulphopyridinium-compound) and a first lass brightener (such as sodium metabenzenedisulphonate) as in the reference cited hereinbefore is not necessary.

By using the indicated initial concentration and addition rates in a value equal to or above the minimum value as mentioned, the addition of more than one compound is no longer necessary for reasons of internal stress. Instead of one compound with mixed character (first and second class) a mixture of such compounds of course also may be used.

For reasons of hardness in some cases it may be advantageous to include additionally one or more chemical compound(s) having predominantly properties of a second class brightener in the bath. Examples of such compounds are ethylene cyanohydrin or 1,4-butyndiol.

Advantageously, the chemical compound to be used having the properties of a first- and of a second-class brightening agent is chosen from the groups of organic compounds described hereinafter.

A first group comprises organic compounds such as:

sulphonated aryl halides, for example o-sulphobenzaldehyde, sulphonated allyl and vinyl compounds, for example allylsulphonic acid, sulphonated acetylenic compounds, for example 2-butyn-1,4-disulphonic acid and $\beta$-cyanoethyl thioether, thiourea and derivatives, for example allylthiourea and o-phenylenethiourea(2-mercaptobenzimidazole).

A further group of organic compounds is as follows: heterocyclic compounds containing sulphoalkyl, sulphoalkenyl, sulphoalkynyl, sulphoalkylaryl and sulphoarylalkyl groups and containing one or more N atoms, the alkyl, alkenyl, alkynyl, alkylaryl or arylalkyl group containing 1–5 carbon atoms in the chain, such as sulphoalkylpyridine and sulphoalkylpyrimidine compounds, for example 1-(3-sulphopropyl)pyridine and 1-(2-hydroxy-3-sulphopropyl)pyrimidine and sulphoalkyl quinoline or sulphoalkyl isoquinoline compounds such as 1-(3-sulphopropyl) quinoline or 1-(3-sulphopropyl) isoquinoline.

In the large group of organic compounds having both properties of brightening agents of the second and first class, the compounds in which there is a heterocyclic ring containing one or more nitrogen atoms occupy a particular place. The many possible pyridine and pyrimidine and quinoline or isoquinoline compounds have an excellent effect; of these, the pyridine compounds are readily obtainable commercially.

In addition to the condition of preferential growth known in using chemical compounds having properties of a second-class brightening agent, use of a chemical compound which has an effect of reducing the internal stress achieves the result that a sieve material produced according to the method of the invention can be used without any additional annealing treatment.

The reduced internal stress has a beneficial effect as regards the flatness of the sieve material obtained and the dimensional stability thereof.

In the above, the starting point is a previously formed, electrically conducting sieve skeleton which acquires a final thickness by thickening.

Expediently, such a sieve skeleton will be formed by depositing metal on a suitable matrix and stripping it therefrom on reaching a certain thickness in order to be capable of being used in the subsequent electrolytic metal deposition step.

It will be clear that such an electrically conductive sieve skeleton can also be obtained in another manner, for example by providing a sheet-type metal material with perforations in a suitable manner or by providing a non-conducting perforated material with an electrically conducting surface layer.

As regards the fineness of the electrically conducting sieve skeleton material which is used as starting material, there are no particular limitations; finenesses of 10 to 500 mesh (the mesh number gives the number of perforations per linear inch) can be used, materials with a fineness which differs from the above-mentioned range not being ruled out.

The method according to the invention can be used to produce a sieve material of any desired type, that is to say, of fineness, thickness, open surface area and metal type to be chosen as desired.

As a result of the feature of a reduced internal stress, the method according to the invention offers, in particular, the possibility of using the method to produce a seamless cylindrical metal sieve material, in which, starting from a seamless cylindrical sieve skeleton having a thickness of 1 to 250 μm, a seamless cylindrical sieve material is obtained having a thickness of up to 1500 μm by thickening the sieve skeleton by metal deposition.

The production of a seamless cylindrical sieve skeleton is known per se in the prior art.

As a result of the feature of an appreciably reduced internal stress (tensile stress), the method according to the invention is especially suitable, in particular, for producing a cylindrical sieve material. With the aid of the method of the invention, a sieve material having a considerable preferential growth nature, (that is to say, with a growth ratio of greater than 2) is obtained which, in addition, has a high dimensional stability which is reproducible.

Although, in principle, all electrolytically depositable metals will be satisfactory in the method according to the invention, the method will very often be used in conjunction with the much used metals, such as nickel, copper and iron. The method according to the invention is not limited thereto; other metals such as chromium, zinc, gold and alloys of metals such as nickel-cobalt, phosphor nickel, brass, etc. will suffice if the chemical compounds according to the present invention are used.

The usable finenesses are, in general between 10 and 500 mesh, that is to say, 10 to 500 perforations per 25.4 mm, said perforations being arranged in a regular pattern. The hole patterns do not, however, necessarily have to be symmetrical; a pattern of randomly placed perforations of mutually different dimension and shape may also be present in an initial sieve skeleton which is thickened to a final thickness using the method according to the invention.

As specified earlier, the initial sieve skeleton can also be formed by a non-conducting material such as a plastic whose surface is covered with an electrically conducting layer so that metal deposition on the surface In the method described above for forming a cylindrical material, a sieve skeleton of 20 to 60 μm thick may, in particular, be employed.

In a particular embodiment of the method described above, the starting point is a cylindrical nickel sieve skeleton having a thickness of 50 μm and an open surface area of 70% which is thickened with nickel in one metal-deposition step until a thickness of 900 μm has been reached, with an open surface area of 50%. A typical fineness in such a case is 22 mesh, that is to say 22 holes per linear inch (25.4 mm).

In another attractive embodiment of the method, a cylindrical seamless sieve material is made by starting from an iron sieve skeleton having a thickness of 100 μm and an open surface area of approximately 20% which is thickened on two sides with nickel until a thickness of 1200 μm is reached with a transmission of approximately 16%. In this way, a core material having high tensile strength (iron) is clad with a nickel surface layer, the nickel providing the corrosion resistance for the sieve material desired for many applications.

Of course, the sieve materials specifically described above can be produced with the same success in flat form.

In order to further reinforce the effect of preferential growth, that is to say the achievement of growth ratios greater than 1, in particular greater than 2, in the method according to the invention as described here, one of the following measures may be resorted to:

During at least part of the time required for thickening, bath liquid flow is brought about through the perforations of the sieve skeleton in a direction which is perpendicular to the sieve skeleton, Thickening is carried out using a pulsating current which comprises pulse current periods (T) and current-free or reversed pulse current periods (T'), where T and T' are set, independently of each other, between 0 and 9900 msec.

These measures are known per se and described, inter alia, in EP-A1-0 049 022 and EP-A1-0 079 642, respectively. In said publications, the effect of using flow through the perforations of the sieve material or the use of a pulsed current during the growth is described in conjunction with the use of chemical compounds which have properties of a second-class brightening agent. As a result of using the specific second-class brightening agents which result in a reduction in the internal stress and which form the subject of the present application, a product is obtained which is characterised, on the one hand, by a beneficial growth ratio, that is to say, a growth ratio of greater than 1 and, more particularly, greater than 2, while the material has, at the same time, a low internal stress directly after its formation, that is to say, appreciably lower than the internal stress which is measured in a sieve material which is produced using the hitherto common chemical compounds having properties of a second-class brightening agent.

The invention furthermore relates to a sieve material which is produced using the method according to the invention as described above, the sieve material being a flat or seamless cylindrical sieve material.

In particular, in relation to the growth nature, the sieve material has a growth ratio $R \geqq 2$ and an internal stress P which is less or equal to 2.0 kg per $mm^2$ (internal stress; tensile stress).

With respect to the possibility described above of producing a flat or cylindrical seamless metal sieve material which has a low internal stress immediately after production without using an annealing process of any kind while, on the other hand, as a result, for example, of using bath liquid flow through the perforations of the sieve skeleton a still greater influencing of the growth ratio is achieved, the following is furthermore pointed out.

To produce a uniform sieve material, the bath liquid flow will generally take place in a direction which is perpendicular to the initial sieve skeleton; a flow in the specified direction is, however, unnecessary. If a flow direction is used which differs from the specified direction, for example a flow which makes an angle to the perpendicular line to the sieve skeleton, a growth will be observed which is preferential in a direction which corresponds to the flow direction. A different flow direction can also be applied in various parts of the thickening bath used, so that various forms of preferential growth of the same sieve material may occur in the flat or cylindrical state.

If flow is used, a laminar flow of bath liquid will generally be established through the perforations of the sieve skeleton connected as cathode; the Reynolds number which fits such a flow is therefore $\leqq 2100$.

SURVEY OF THE DRAWINGS

The invention will now be explained with reference to the drawing, wherein.

DESCRIPTION OF THE PREFERRED EMBODIMENTS

Figure 1:
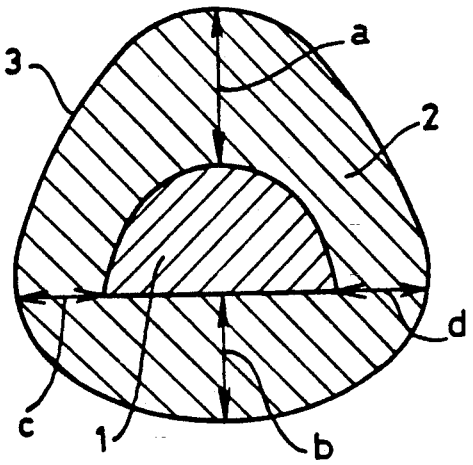
FIG. 1 shows a crosspiece of a sieve material in cross section.

In FIG. 1, the sieve skeleton is indicated by the thickening growth by 2 and the total sieve material by 3. In the drawing, a and b are the growths perpendicular to the plane of the sieve skeleton at the point of maximum thickness, while c and d are the lateral growth in the base plane of the skeleton. The growth ratio already mentioned frequently above is defined as $$R = \frac{a + b}{c + d}$$

If the sieve skeleton 1 is thickened without additional measures of bath liquid flow and/or pulsating current, a growth ratio of greater than 1, and in particular, for example, between 1.3 and 2.5 will generally be achieved. If such a sieve material is formed class brightening agent, such as butyndiol or ethylenecyanohydrin, an internal stress (tensile stress) is observed of approximately 4.5 $kg/m^2$. If one of the compounds which form the subject of the invention is used, for example a compound having properties of brightening agents of the first and the second class such as 1-(3-sulphopropyl)-pyridine or 1-(2-hydroxy-3-sulphopropyl)pyridine, an internal stress is measured of 1.5 $kg/mm^2$. The measurement of the internal stress is carried out by carrying out a test in which an adhering metal deposit is formed under standard conditions on a base and that the change in length of the substrate as a consequence of the stress in said deposit is measured (apparatus IS* meter of Oxy Metal Finishing Corp.).

*IS=Internal Stress.

The sieve material according to the invention is also characterised by an increased elongation at break. The following may serve as a comparison. A screen-material having a fineness of 305 mesh (305 holes per linear inch) exhibited an elongation at break of 1 mm with a load of 150 newtons prior to an annealing treatment and an elongation at break of 2.5 mm for 120 newtons after the annealing treatment. The same screen-material of the same thickness and produced by the method of the invention exhibited, without using an annealing treatment of any kind, an elongation at break of more than 1.2 mm with a load of 250 newtons. In both cases, the starting point was a nickel skeleton which had been thickened with nickel to a final thickness.

The elongation tests for Ni sieve material are carried out according to a method which is related to DIN 50125. A test rod which corresponds in terms of shape to a test rod used in said DIN specification is prepared; the thickness does not comply with the DIN standard.

In view of the sieve nature of the material to be investigated, a test rod is always punched in the same way from a sheet of material so that the pattern orientation in the test rod is always the same.

With regard to elongation under stress it is observed that the strength, due to the use of the organic compounds according to the invention, is markedly increased.

In the case of a sieve material produced according to the invention elongation at break occurs at a markedly higher stress than with a sieve material produced with a prior art method. The modulus of elasticity remains essentially unaffected.

Incidentally, in the case of the chemical compounds used according to the invention, a number of advantages are furthermore observed which will be described below, in addition to the marked reduction in the internal stress.

In the first place it is pointed out that, to maintain a certain growth ratio with time, less topping up of the bath with the compound used is necessary. It is assumed that the decomposition products originating as a consequence of cathodic decomposition of said additive also has an effect on the selective growth of the metal, as a result of which, viewed in time, less topping up with said agent needs to take place.

Another advantage is that the cathode efficiency is 90 to 95% if the present means are used, while, if common compounds having properties of a second-class brightening agent are used, it is approximately 80% (the cathode efficiency is the ratio of the number of coulombs theoretically necessary in order to form a certain metal deposit and the actual number of coulombs used).

FIGS. 2–6 show graphs in which the effects of using the chemical compounds having stress-reducing action and common chemical compounds are compared.

As an example of a compound having stress-reducing action, 1-(2-hydroxy-3-sulphopropyl)pyridine betaine was chosen. A product of Raschig AG, Ludwigshafen (Germany); this product is referred to as PPS-OH below.

As an example of a common chemical compound for obtaining a specific growth nature in thickening by electroplating, hydroxypropionitrile, referred to as HPN below, was used.

The starting point was always a nickel sieve skeleton having a fineness of 305 mesh (305 perforations per linear inch); thickening took place with nickel in a bath containing PPS-OH or HPN.

Figure 2:
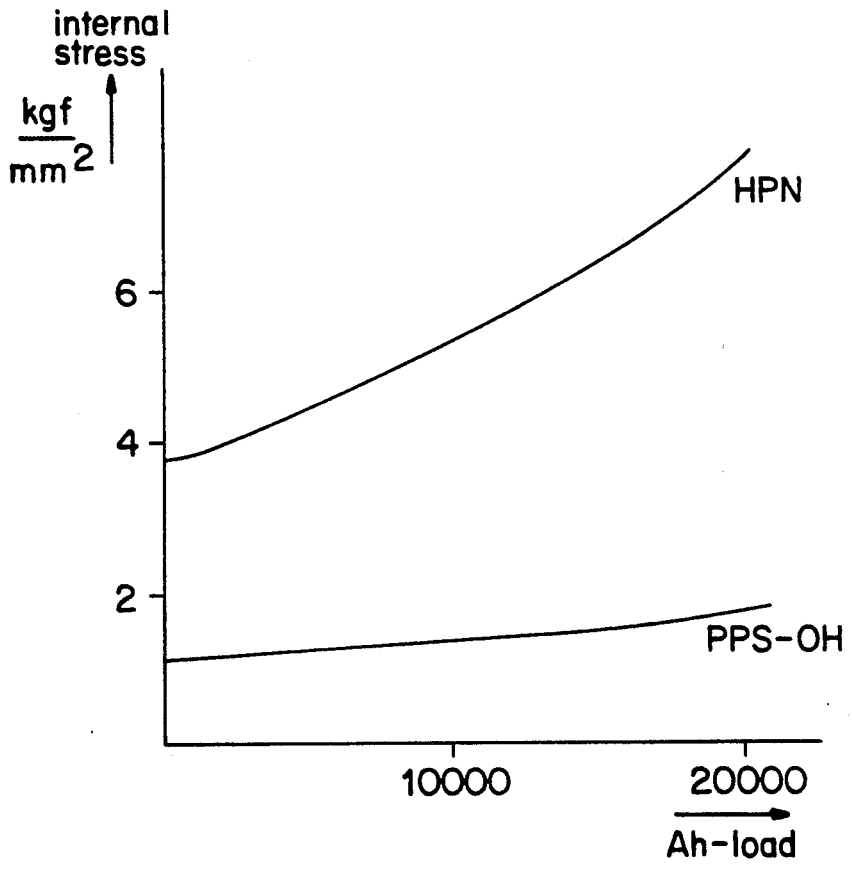
FIGS. 2–6 show graphs which illustrate the effect of the use of stress-reducing chemical compounds.

FIG. 2 shows the effect on the internal stress for an increasing number of ampere-hours passed, as a function of the additive used. It is clear that, over the entire load range, PPS-OH gives rise to an internal stress which is appreciably reduced with respect to the situation in which HPN is used. The bath concentration of PPS-OH and HPN were in this case the same.

Figure 3:
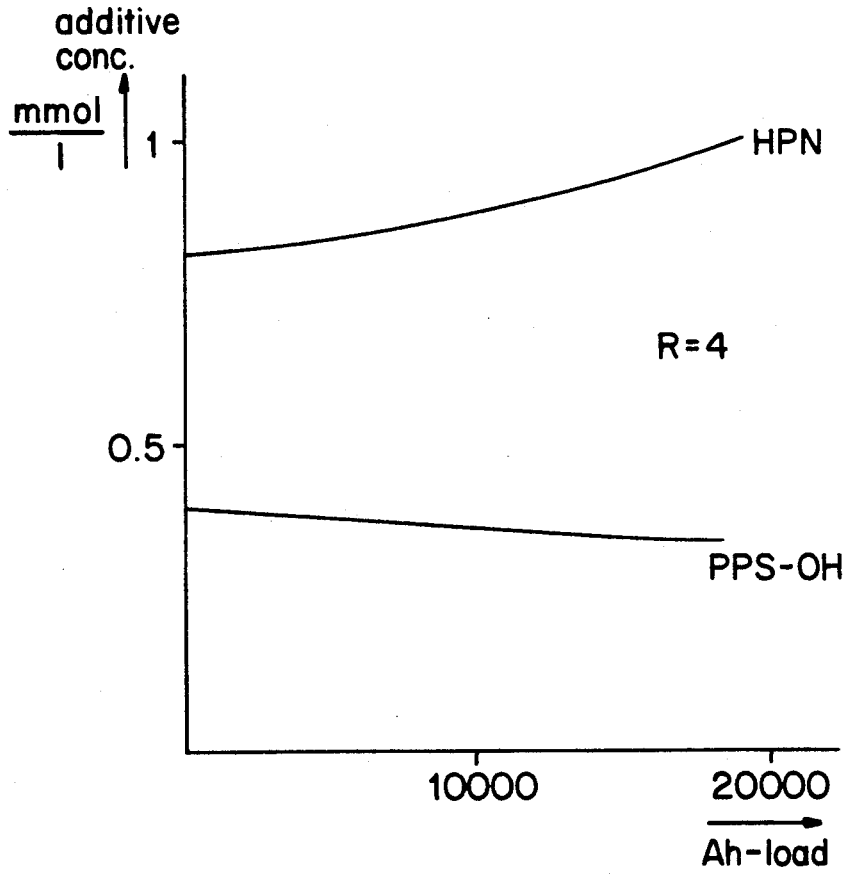

FIG. 3 shows the variation in the bath concentration of additive as a function of the load. In this case, the growth ratio R was kept constant at 4.

It is clear that in this case the bath concentration of PPS-OH may be set somewhat lower and that no additional PPS-OH needs to be added with increasing load in order to produce the same growth ratio, which is in fact the case for HPN. It is assumed that certain decomposition products of PPS-OH also have a preferential growth nature as well as a stress-reducing action.

Figure 4:
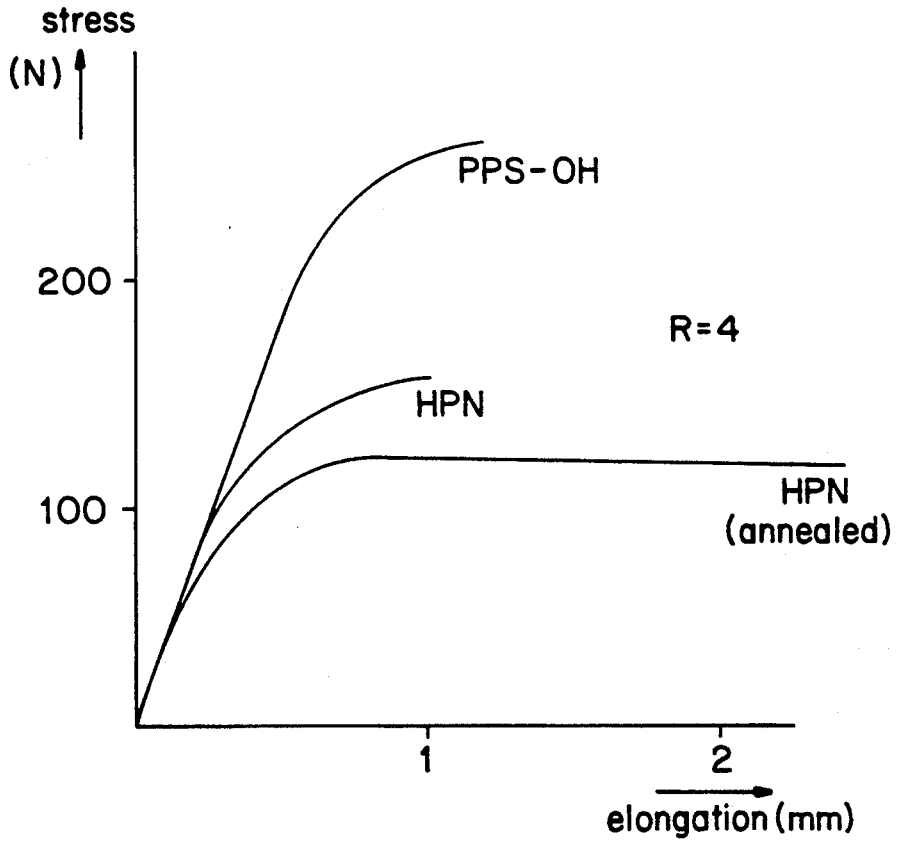

In FIG. 4, the elongation at break is plotted against the tensile stress, with equal additive concentrations of PPS-OH and HPN being used.

It is clear that, if PPS-OH is used, a greater tensile strength is obtained in all cases.

Figure 5:
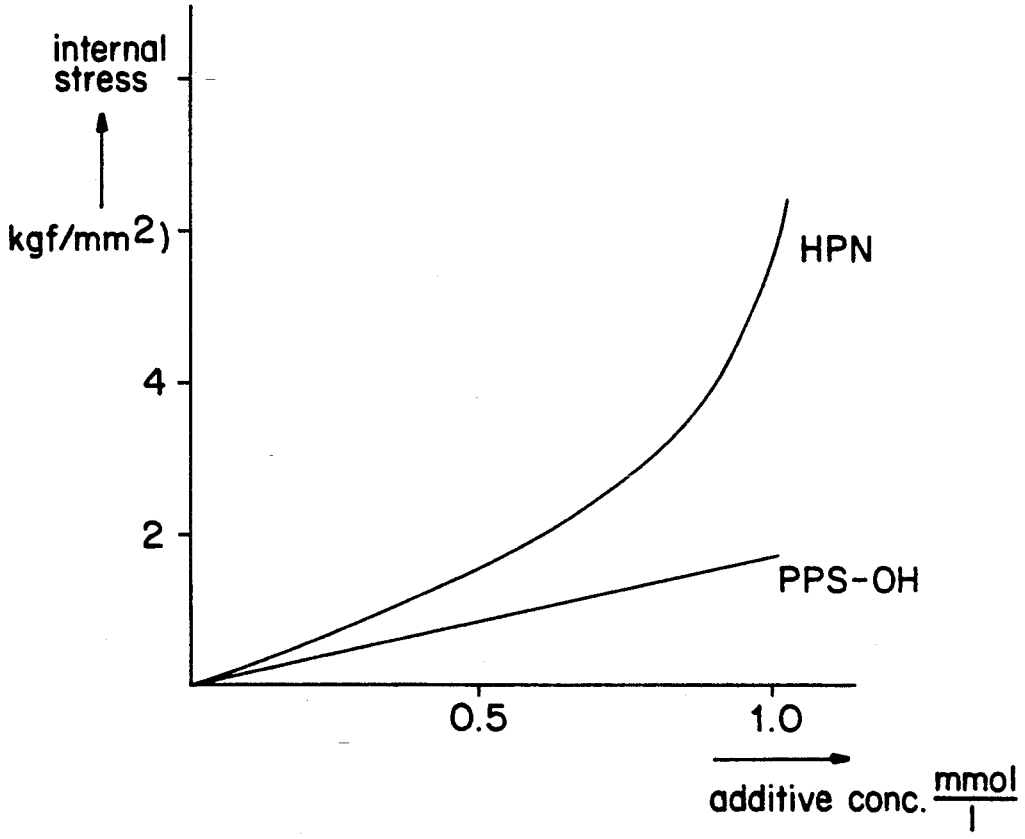

FIG. 5 shows the relation between internal stress and additive concentration using HPN and PPS-OH.

It is clear that use of PPS-OH results in a lower internal stress in all cases.

Figure 6:
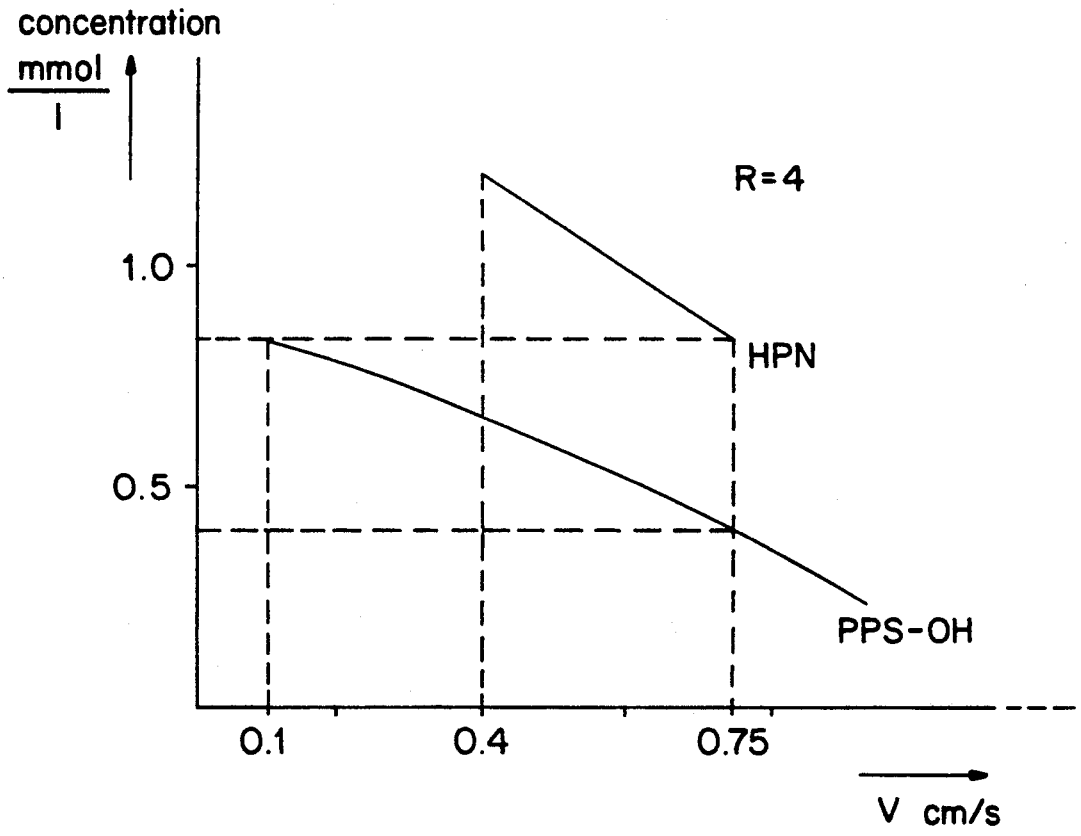

Finally, FIG. 6 shows the situation in which a 305 mesh sieve skeleton has been thickened using HPN and PPS-OH, the growth ratio being set constant at 4.

Working lines have been shown in which the bath additive concentration and the flow rate of the bath liquid through the perforations of the screen are taken as parameters. It can again be seen that, to achieve a certain growth ratio, a PPS-OH concentration is necessary which is lower than the HPN concentration needed for the same effect.

In both cases, the required additive concentration drops with increasing flow rate.

In all the above graphs, the scales on the axes have been adjusted for the sake of clarity which, in certain cases produces a deviation from linearity; the numerical values indicated in the scales correspond fully to the values actually measured.

In Table 1 which is attached, a number of relevant values, which form the basis of the graphs in FIGS. 2–6, are summarized.

In the following examples a few experiments are described of the method according to the invention.

EXAMPLE I

Electrolyte: sulphamate
Sieve type: 305 mesh; flat; R=4
Conc. PPS-OH: 0.4 mmol/l.
Addition rate: 2.8 mol/10,000 Ah.
Current density: 13 A/dm$^2$
Internal stress: 1.2 kgf/mm$^2$.

EXAMPLE II

Electrolyte: Watts.
Sieve type: 165 mesh; cylindrical; R=8
Conc. PPS-OH: 1 mmol/l.
Addition rate: 1.5 mol/10,000 Ah.
Current density: 40 A/dm$^2$
Internal stress: 1.4 kgf/mm$^2$ In both examples the internal stress appears to be low in comparison with a situation wherein a conventional second class brightener is used (compare FIG. 5) or a low addition rate of brightener with properties of a first and second class brightener is used.

What is claimed is:

1. Method for forming a sieve material comprising thickening a previously formed, electrically conducting sieve skeleton by metal deposition in an electrolysis bath until the final thickness of the sieve material has been reached, wherein the bath includes one or more chemical brightening compounds in the bath having the properties of both a first-class and a second-class brightening agent, said compound being present in the bath in such concentration and being added to the bath in such proportionality to the Ah (Ampere hour) load that the internal stress of the finished sieve material with respect to a material formed using one or more conventionally used Class II brightener is reduced wherein the brightener is a sulphur-containing organic compound having at least one unsaturated bond in the molecule and is used in an initial concentration of at least 0.25 mmol/liter of bath liquid and an addition rate of at least 1 mol/10,000 Ah load; and wherein one or more of the following conditions apply during thickening:

during at least part the time needed for thickening, bath liquid flow is brought about through the perforations of the sieve skeleton in a direction which is perpendicular to the sieve skeleton, the thickening is carried out using a pulsating current which comprises pulse current periods (T) and current-free or reverse current periods (T'), where T and T' are set, independently of each other between 0 and 9900 msec.

2. Method according to claim 1, wherein the chemical brightening compound is selected from the group consisting of sulphonated aryl aldehydes, sulphonated allyl and vinyl compounds, sulphonated acetylenic compounds, and thiourea and thiourea derivatives.

3. Method according to claim 1, wherein: the chemical brightening compound is selected from the group consisting of heterocyclic compounds containing sulphoalkyl, sulphoalkenyl, sulphoalkynyl, sulphoalkylaryl, and sulphoarylalkyl groups and 1 or more N atoms, and wherein the alkyl, alkenyl, alkynyl, alkylaryl, and arylalkyl groups each contain 1-5 carbon atoms in the nonaryl portion of the group.

4. Method of producing a seamless cylindrical metal sieve material using the method according to claim 1, in skeleton having a thickness of 1-250 μm, a seamless cylindrical sieve material is obtained having a thickness of up to 1500 μm by thickening it by metal deposition.

5. Method according to claim 4, in which the starting point is a sieve skeleton having a thickness of 20-60 μm.

6. Method according to claim 4, in which a nickel sieve skeleton having a thickness of 50 μm and an open surface area of 70% is thickened in one metal deposition step with nickel until a thickness of 900 μm has been reached with an open surface area of 50%.

7. Method according to claim 4, in which an iron sieve skeleton 100 μm thick and having an open surface area of approximately 20% is thickened on both sides with nickel until a thickness of 1200 μm has been reached with a transmission of approximately 16%.

8. A method according to claim 1 wherein additionally one or more chemical compounds having predominantly properties of a second class brightener are present.

9. A method according to claim 1, wherein: the brightener is used in an initial concentration of at least 0.75 mmol/liter of bath liquid and an addition rate of at least 3 mol/10,000 Ah load.

10. Method according to claim 2, wherein: the chemical brightening compound is selected from the group consisting of o-sulpho-benzaldehyde, allylsulphonic acid, 2-butyn-1,4-disulphonic acid, β-cyanoethyl thioether, allylthiourea, and o-phenylenethiourea (2-mercaptobenzimidazole).

11. Method according to claim 3, wherein the chemical brightening compound is selected from the group consisting of 1-(3-sulphopropyl)pyridine, 1-(2-hydroxy-3-sulphopropyl)pyridine, 1-(3-sulphopropyl)quinoline, and 1-(3-sulphopropyl)isoquinoline.

* * * * *